US011337887B2

(12) United States Patent
Zhijian

(10) Patent No.: US 11,337,887 B2
(45) Date of Patent: May 24, 2022

(54) ADJUSTABLE MASSAGE APPARATUS

(71) Applicant: Li Zhijian, Fujian (CN)

(72) Inventor: Li Zhijian, Fujian (CN)

( * ) Notice: Subject to any disclaimer, the term of this patent is extended or adjusted under 35 U.S.C. 154(b) by 151 days.

(21) Appl. No.: 16/885,324

(22) Filed: May 28, 2020

(65) Prior Publication Data

US 2020/0330316 A1 Oct. 22, 2020

Related U.S. Application Data

(63) Continuation-in-part of application No. 16/850,043, filed on Apr. 16, 2020, which is a continuation-in-part of application No. 16/693,452, filed on Nov. 25, 2019, now Pat. No. 10,888,494, which is a continuation-in-part of application No. 16/693,259, filed on Nov. 23, 2019.

(60) Provisional application No. 62/854,261, filed on May 29, 2019, provisional application No. 62/834,551, filed on Apr. 16, 2019.

(51) Int. Cl.
*A61H 15/00* (2006.01)

(52) U.S. Cl.
CPC ..... *A61H 15/00* (2013.01); *A61H 2015/0021* (2013.01); *A61H 2201/1454* (2013.01); *A61H 2201/1614* (2013.01); *A61H 2201/1623* (2013.01); *A61H 2201/1652* (2013.01); *A61H 2201/5097* (2013.01)

(58) Field of Classification Search
CPC ..... A61H 15/0078; A61H 2201/0157; A61H 2201/1215; A61H 2201/138; A61H 2201/1626; A61H 2201/1652; A45F 3/047; A45F 3/14; A47D 13/02
See application file for complete search history.

(56) References Cited

U.S. PATENT DOCUMENTS

| | | | |
|---|---|---|---|
| 3,957,184 | A | 5/1976 | Shurman |
| 6,816,760 | B1 | 11/2004 | Namaky |
| 6,870,089 | B1 | 3/2005 | Gray |
| 9,144,255 | B1 | 9/2015 | Perciballi |
| 10,561,225 | B2 | 2/2020 | Parekh |
| 10,616,534 | B2 | 4/2020 | Thiel |
| 2002/0198031 | A1 | 12/2002 | Holmes |
| 2003/0062391 | A1 | 4/2003 | Mitchell |
| 2003/0168488 | A1 | 9/2003 | Ho |
| 2005/0020184 | A1 | 1/2005 | Izcoa |
| 2005/0140331 | A1 | 6/2005 | McQuade |
| 2006/0113343 | A1 | 6/2006 | Chang |
| 2007/0297149 | A1 | 12/2007 | Richardson |
| 2008/0011799 | A1 | 1/2008 | Chang |
| 2008/0125164 | A1 | 5/2008 | Singh |

(Continued)

FOREIGN PATENT DOCUMENTS

KR 2014132850 A 11/2014

*Primary Examiner* — Brian D Nash

(74) *Attorney, Agent, or Firm* — Jennifer Meredith, Esq.; Meredith Attorneys, PLLC

(57) ABSTRACT

An adjustable massage apparatus with: a body, a back panel, and at least two shoulder straps, the back panel has at least one massage apparatus and a substantially rigid material that is at least 1 mm thick, the massager apparatus has at least two massage heads which are retained on the back panel inside at least one tunnel, each of the massage heads are fixed on a band to provide the massage head on the band and moving in the tunnel which is substantially the same width as each of the massage heads.

36 Claims, 20 Drawing Sheets

(56) References Cited

U.S. PATENT DOCUMENTS

| | | | | |
|---|---|---|---|---|
| 2008/0210728 | A1 | 9/2008 | Bihn | |
| 2009/0061926 | A1 | 3/2009 | Lee | |
| 2009/0201671 | A1 | 8/2009 | Huntley | |
| 2009/0224722 | A1 | 9/2009 | Causey | |
| 2009/0276089 | A1 | 11/2009 | Bartholomew | |
| 2010/0155447 | A1* | 6/2010 | Zheng | A45F 3/047 224/576 |
| 2011/0110514 | A1 | 5/2011 | Gustavsson | |
| 2012/0262117 | A1 | 10/2012 | Ferber | |
| 2012/0299528 | A1 | 11/2012 | Scarmozzino | |
| 2013/0026726 | A1 | 1/2013 | Thomas | |
| 2013/0162389 | A1 | 6/2013 | Crucs | |
| 2013/0214931 | A1 | 8/2013 | Chia | |
| 2013/0249673 | A1 | 9/2013 | Ferrari | |
| 2014/0002239 | A1 | 1/2014 | Rayner | |
| 2014/0061273 | A1 | 3/2014 | Bullivant | |
| 2014/0171132 | A1 | 6/2014 | Ziemianska | |
| 2015/0296644 | A1 | 10/2015 | Chin | |
| 2015/0326044 | A1 | 11/2015 | Ashley | |
| 2015/0359127 | A1 | 12/2015 | Daoura | |
| 2015/0366333 | A1 | 12/2015 | Zhijian | |
| 2016/0095782 | A1* | 4/2016 | Shockley, Jr. | A61H 23/0254 601/93 |
| 2016/0095788 | A1* | 4/2016 | Cottrell | A61H 23/02 601/46 |
| 2016/0112004 | A1 | 4/2016 | Thiel | |
| 2016/0118634 | A1 | 4/2016 | Thiel | |
| 2016/0141904 | A1 | 5/2016 | Zhijian | |
| 2017/0027806 | A1 | 2/2017 | Lin | |
| 2017/0196347 | A1 | 7/2017 | Sawhney | |
| 2019/0343266 | A1 | 11/2019 | Parekh | |
| 2019/0374012 | A1 | 12/2019 | Chang | |
| 2021/0137784 | A1* | 5/2021 | Zhijian | A61H 1/00 |

* cited by examiner

ADJUSTABLE MASSAGE APPARATUS

This application claims priority to provisional patent application 62/854,261 filed May 29, 2019. This application is a continuation-in-part of application Ser. No. 16/850,043 filed Apr. 16, 2020. Application Ser. No. 16/850,043 claims priority to provisional patent application 62/834,551 filed Apr. 16, 2019 and application Ser. No. 16/693,259 filed Nov. 23, 2019, which in turn claims priority to patent application 62/834,551 and Chinese patent application 20190028229.9 filed Jan. 11, 2019. This application is a continuation-in-part and claims priority to patent application Ser. No. 16/693,452 filed Nov. 25, 2019, which in turn claims priority to patent application Ser. No. 16/693,259 filed Nov. 23, 2019. Each of these application Ser. Nos. (62/834,551, 16/693,259, Chinese patent application 20190028229.9, 16/693,452, 16/850,043 and 62/854,261) are incorporated herein by reference.

The purpose of the present invention is to provide massagers that may be moved according to the wishes of the user. Each wearer may want massaging at different points or placement on the body and the present invention is intended to allow for easy, comfortable movement of the massagers without damaging the massager or the power cord.

Another purpose of the present invention is to prevent massage fatigue on a single spot. Being able to move the location of the massager prevent a single spot being overly massaged while ignoring other spots. And the adjustable position of massager can easier to fit users of different heights, body shapes and weights.

The present invention will be discussed in greater detail and with reference to the drawings below.

BRIEF DESCRIPTION OF THE INVENTION

According to one aspect of the present invention, an adjustable massage apparatus is provided comprising a body, a back panel, and at least two shoulder straps. The back panel has at least one massage apparatus and has a substantially rigid material that is at least 1 mm thick. The massager apparatus has at least two massage heads that are retained on the back panel inside at least one tunnel. Each of the massage heads are fixed on a band to provide the massage head on the band and moving in the tunnel. The tunnel is substantially the same width as each of the massage heads.

According to another aspect of the present invention, an adjustable massage apparatus is provided comprising: a body, a back panel, and at least two shoulder straps, wherein the back panel has at least one massage apparatus and has a substantially rigid material that is at least 1 mm thick and the massager apparatus has at least two massage heads with covers that are fixed on a platform.

DETAILED DESCRIPTION OF THE INVENTION

In the following detailed description, numerous specific details are set forth in order to provide a thorough understanding of the disclosure. However, it will be understood by those skilled in the art that the present disclosure may be practiced without these specific details. In other instances, well-known methods, procedures, components and circuits have not been described in detail so as not to obscure the present disclosure.

Reference throughout this specification to "one embodiment" or "an embodiment" means that a particular feature, structure, or characteristic described in connection with the embodiment is included in at least one embodiment of the present disclosure. Thus, the appearances of the phrases "in one embodiment" or "in an embodiment" or "according to one embodiment" (or other phrases having similar import) in various places throughout this specification are not necessarily all referring to the same embodiment. Furthermore, the particular features, structures, or characteristics may be combined in any suitable manner in one or more embodiments. Also, depending on the context of discussion herein, a singular term may include its plural forms and a plural term may include its singular form. Similarly, a hyphenated term may be occasionally interchangeably used with its non-hyphenated version and a capitalized entry may be interchangeably used with its non-capitalized version. Such occasional interchangeable uses shall not be considered inconsistent with each other.

Figure 1:
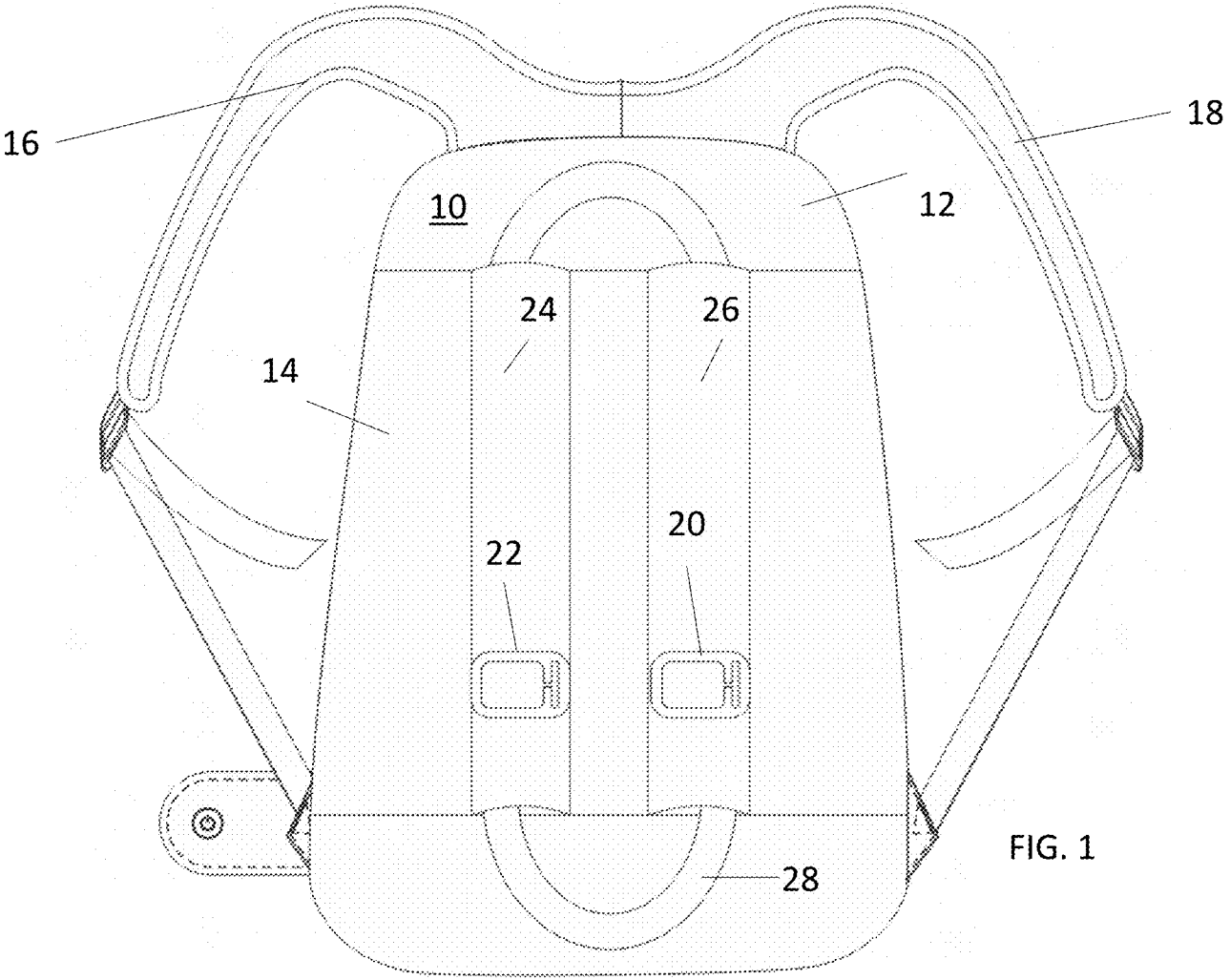
FIG. 1 depicts an adjustable massage apparatus according to the present invention.
Figure 5:
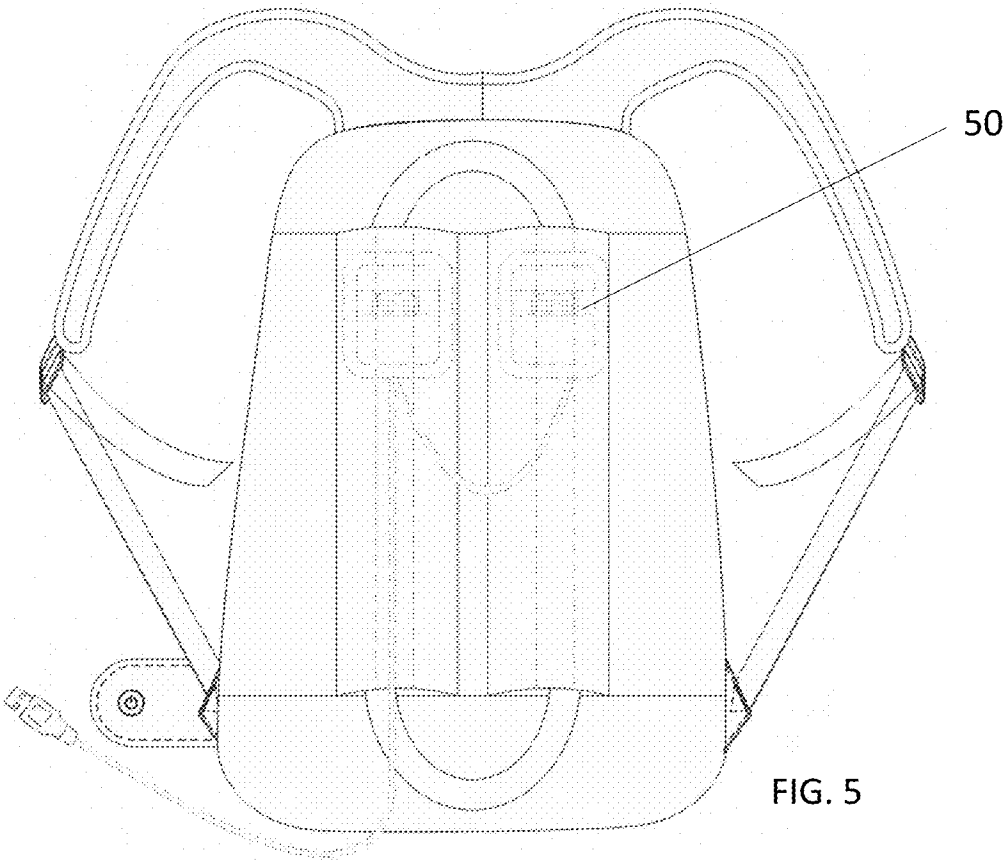
FIG. 5 depicts an adjustable massage apparatus with a sliding buckle according to the present invention.
Figure 8:
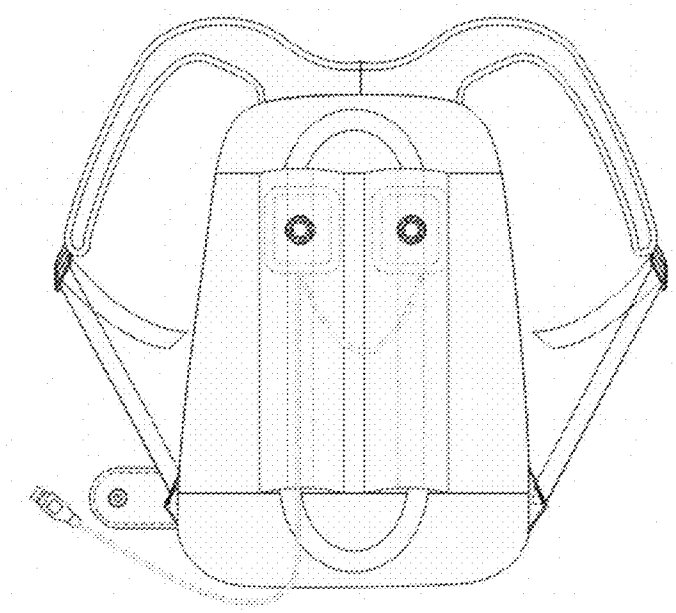
FIG. 8 depicts an adjustable massage apparatus with an antifriction bearing according to the present invention.
Figure 7:
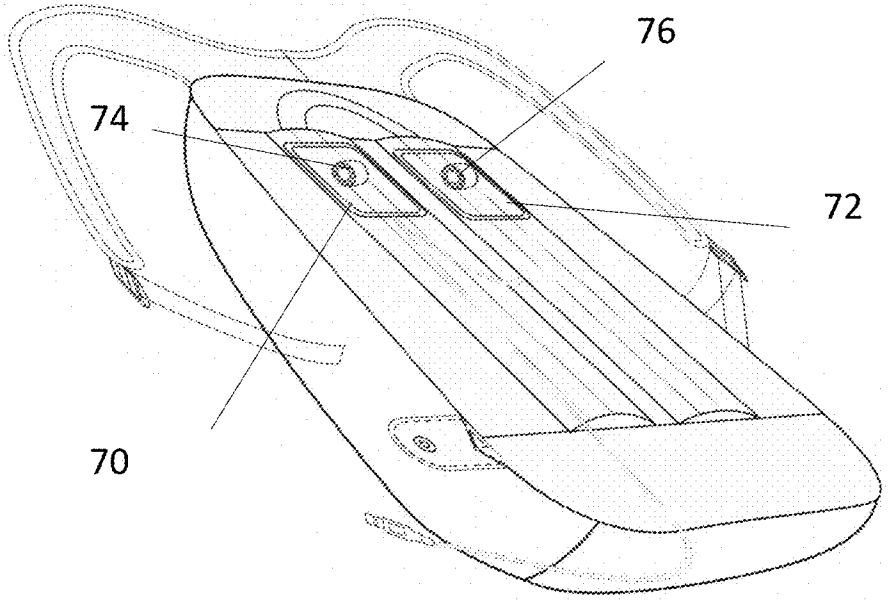
FIG. 7 depicts an adjustable massage apparatus with an antifriction bearing according to the present invention.
Figure 9:
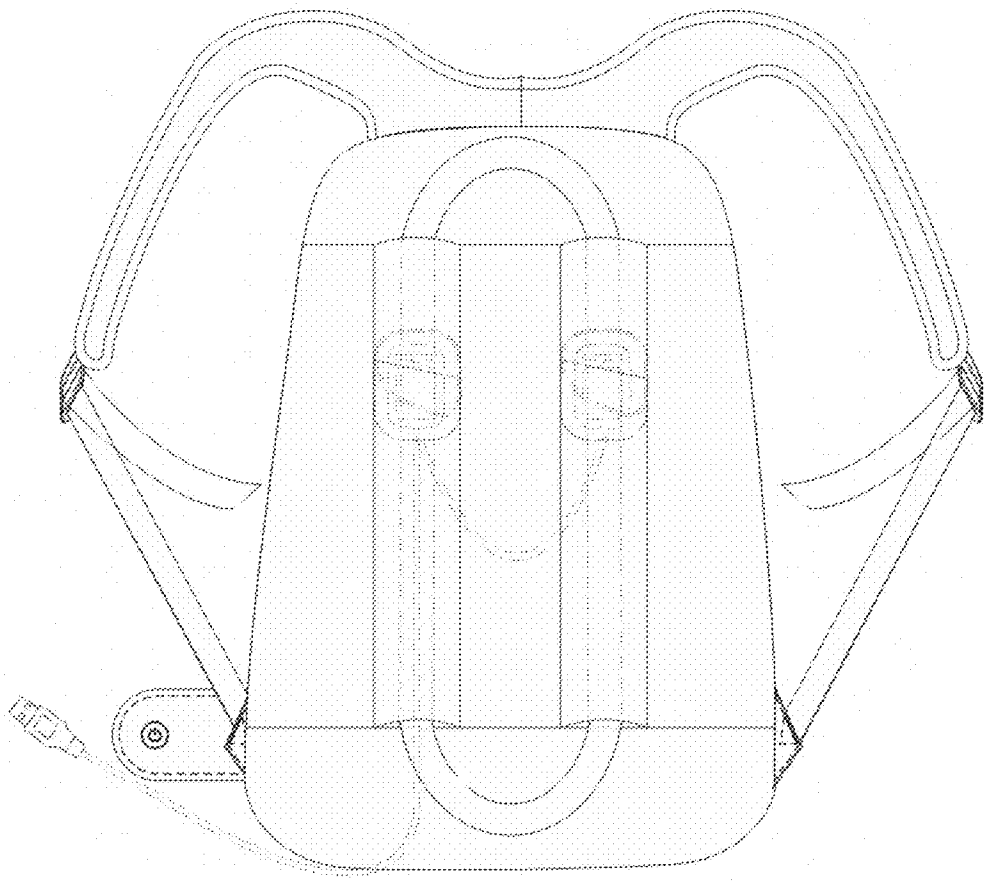
FIG. 9 depicts an adjustable massage apparatus according to the present invention.
Figure 10:
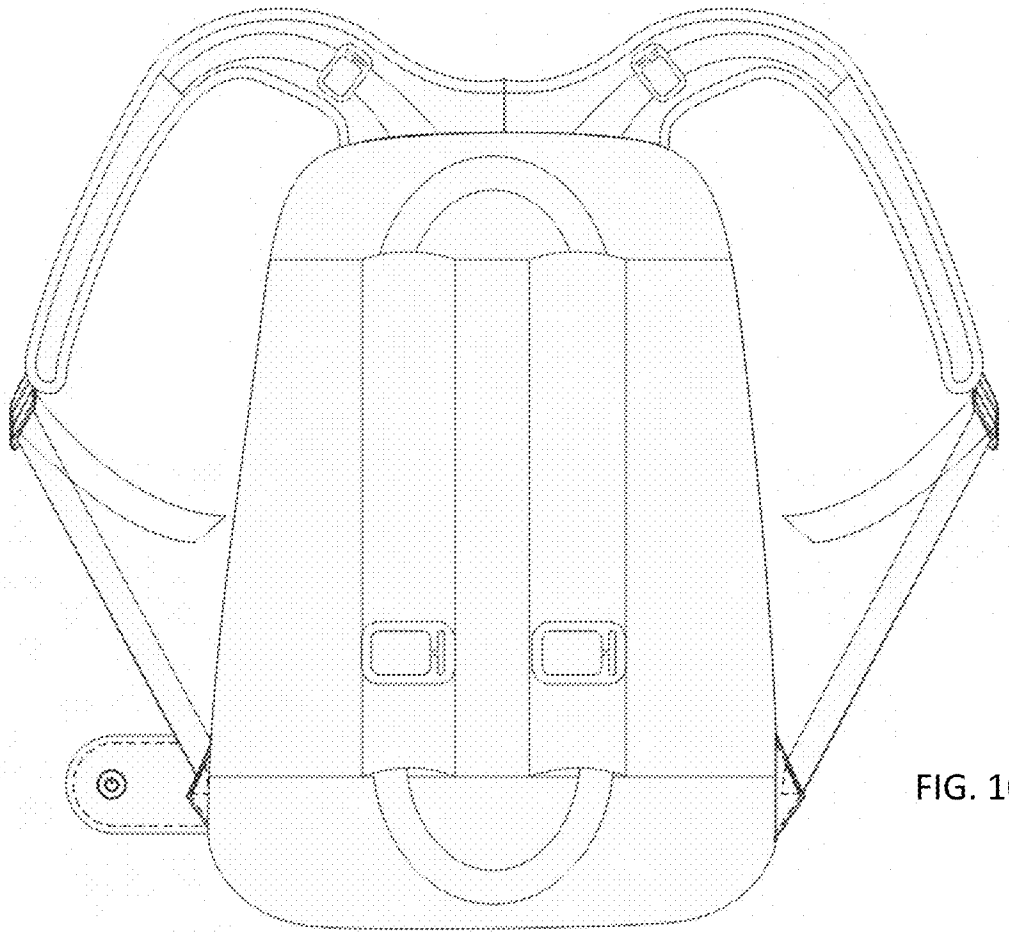
FIG. 10 depicts an adjustable massage apparatus with band ends on shoulder straps according to the present invention.

With reference to FIG. 1, an adjustable massage apparatus (10) is provided comprising: a body (12), a back panel (14), at least two shoulder straps (16, 18) and at least two massage heads (20, 22). The term body refers to the body (12) of the backpack, bag, baby carrier or any other carrying apparatus. The back panel has a substantially rigid material that is at least 1 mm thick. The massager apparatus has at least two massage heads (20, 22) that are retained on the backpack panel inside at least one tunnel (24 and 26). Each of the massage heads (20, 22) are fixed on a band (28) to provide the massage head on the band and moving in the tunnel, wherein the tunnel is substantially in the same width as each of the massage heads. The term band refers to a band rope, webbing, cord, string or any elongated material or fabric. The tunnel being substantially the same width as the massage head allows the massage head to stay in place, particularly during vibration. The tunnel may be made from a material selected from the group consisting of fabric, mesh, elastic, rubber and foam. The massage heads are not depicted in dotted lines in order to depict the location and shape, but they would be contained within the tunnel and may not be seen on the outside of the tunnel. There may also be a cover (30) on the massage head, which would also be contained inside the tunnel and would be attached before being attached to the band. The massage head being held by a cover before being attached to the band protects the massage head so that user will not pull the massage heads directly, but instead they pull the covers. This protects the electronic cable on the massager heads as they do not bear stress. The cover (30) may be a material selected from the group consisting of fabric, mesh, elastic, rubber, silicon and foam. The cover (30) may be further equipped with a stiff bottom material (32) selected from the group consisting of plastic board, cardboard, metalboard. The stiff bottom material allows the massagers to be pulled in the tunnel such that they will not be stopped by a tight tunnel. As depicted in FIG. 5, the massage heads may be fixed on at least one by a sliding buckle (50). The sliding buckle allows the user to pull the band to slide the massage head to the desired position in the tunnel. As depicted in FIGS. 7 and 8, the massage heads (70, 72) may be fixed on a band with an antifriction bearing (74 and 76).

Figure 21:
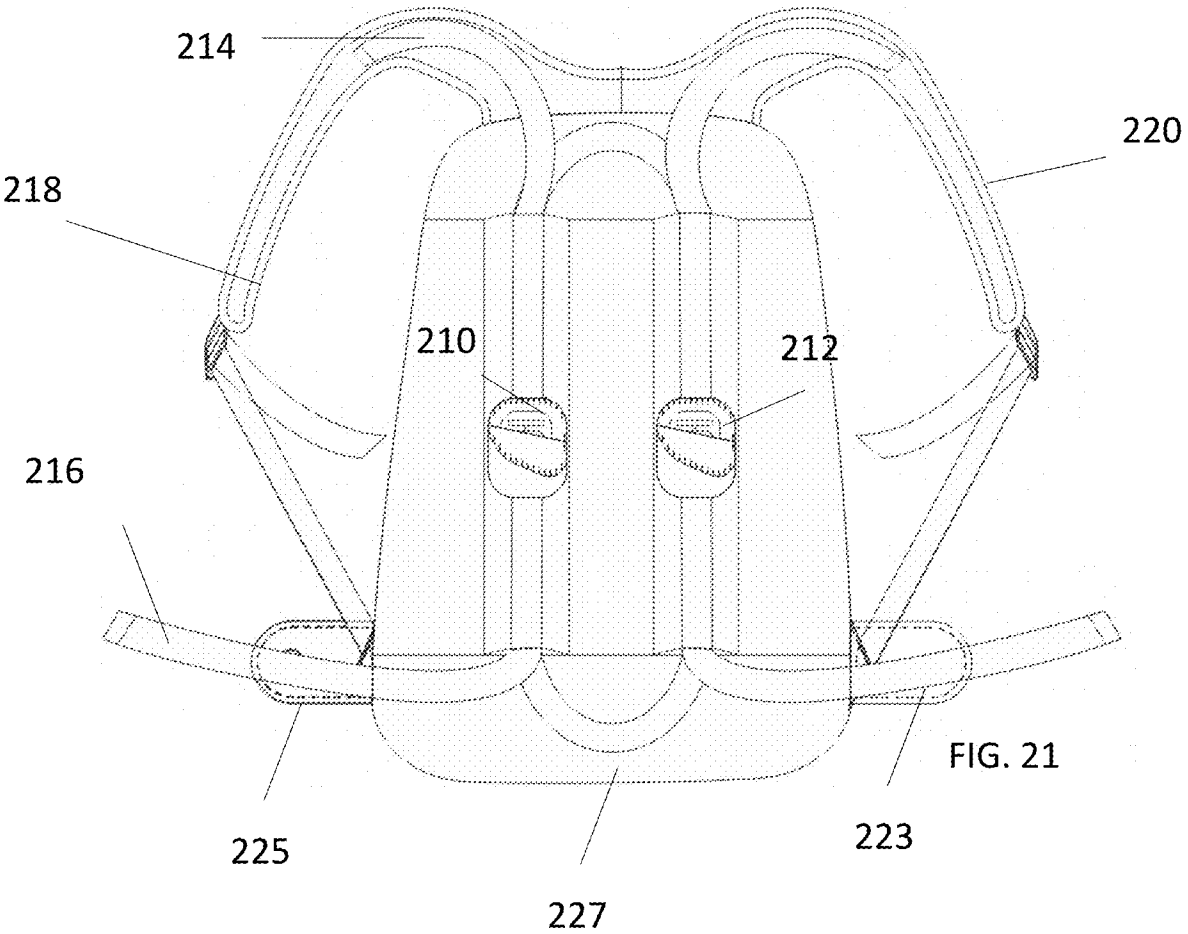
FIG. 21 depicts an adjustable massage apparatus according to the present invention.
Figure 24:
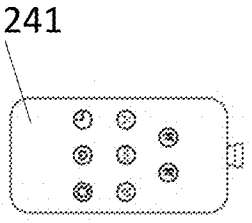
FIG. 24 depicts a wireless control according to the present invention.
Figure 23:
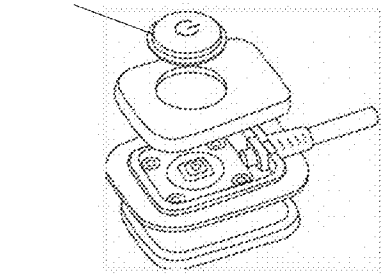
FIG. 23 depicts a wired solid function control board according to the present invention.

As depicted in FIG. 21, each massage head (210 and 212) may be fixed on a band having a first end (214) and a second end (216), the first end of each band is assembled on either one or two of the shoulder straps (218 and 220), and the second end of each band is assembled on either one or two of a waist patch (223, 225 and 227). The user can pull up the band from the shoulder strap, the massage head will move up accordingly, the user can pull down the band from the second end of the band and the massage head will move down accordingly.

Figure 3:
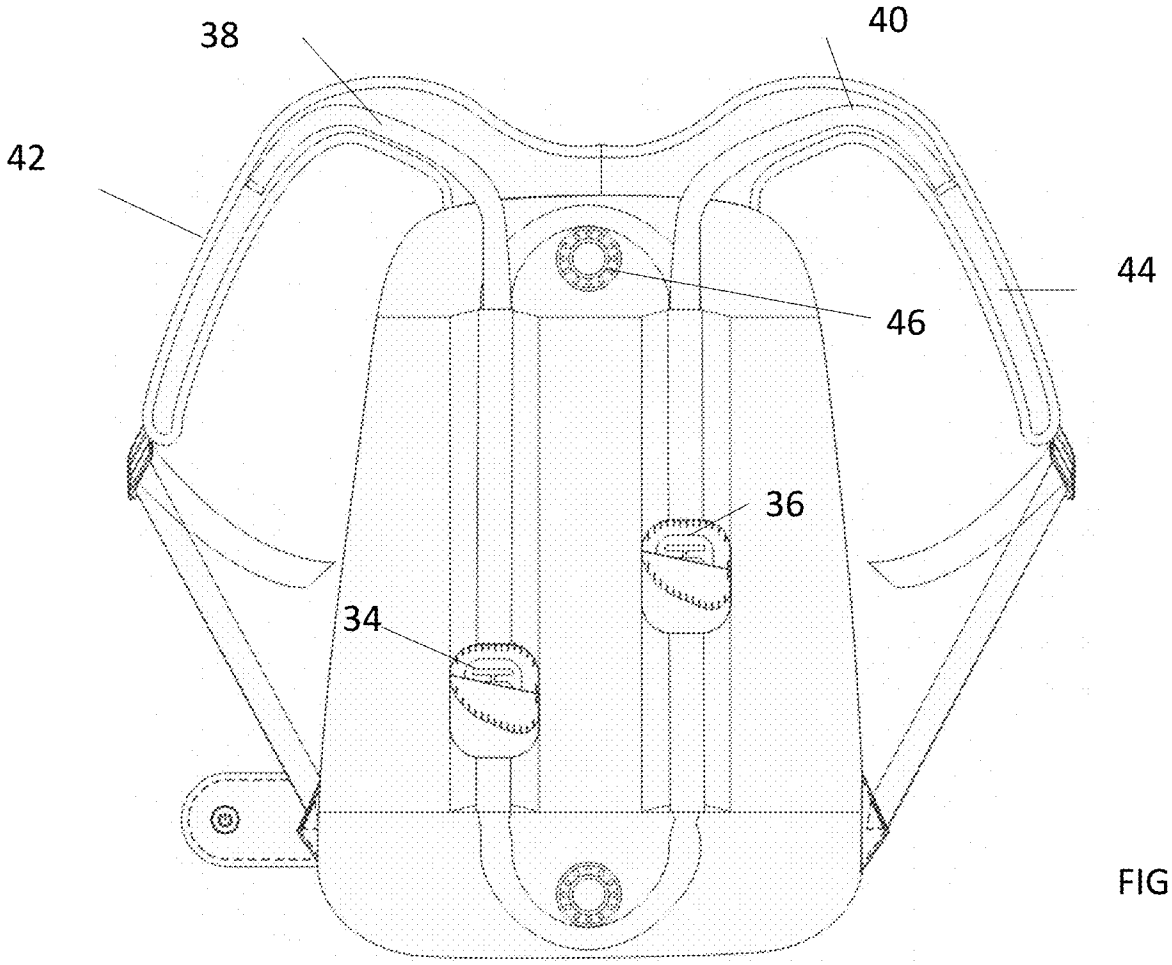
FIG. 3 depicts an adjustable massage apparatus with a roller system according to the present invention.
Figure 4:
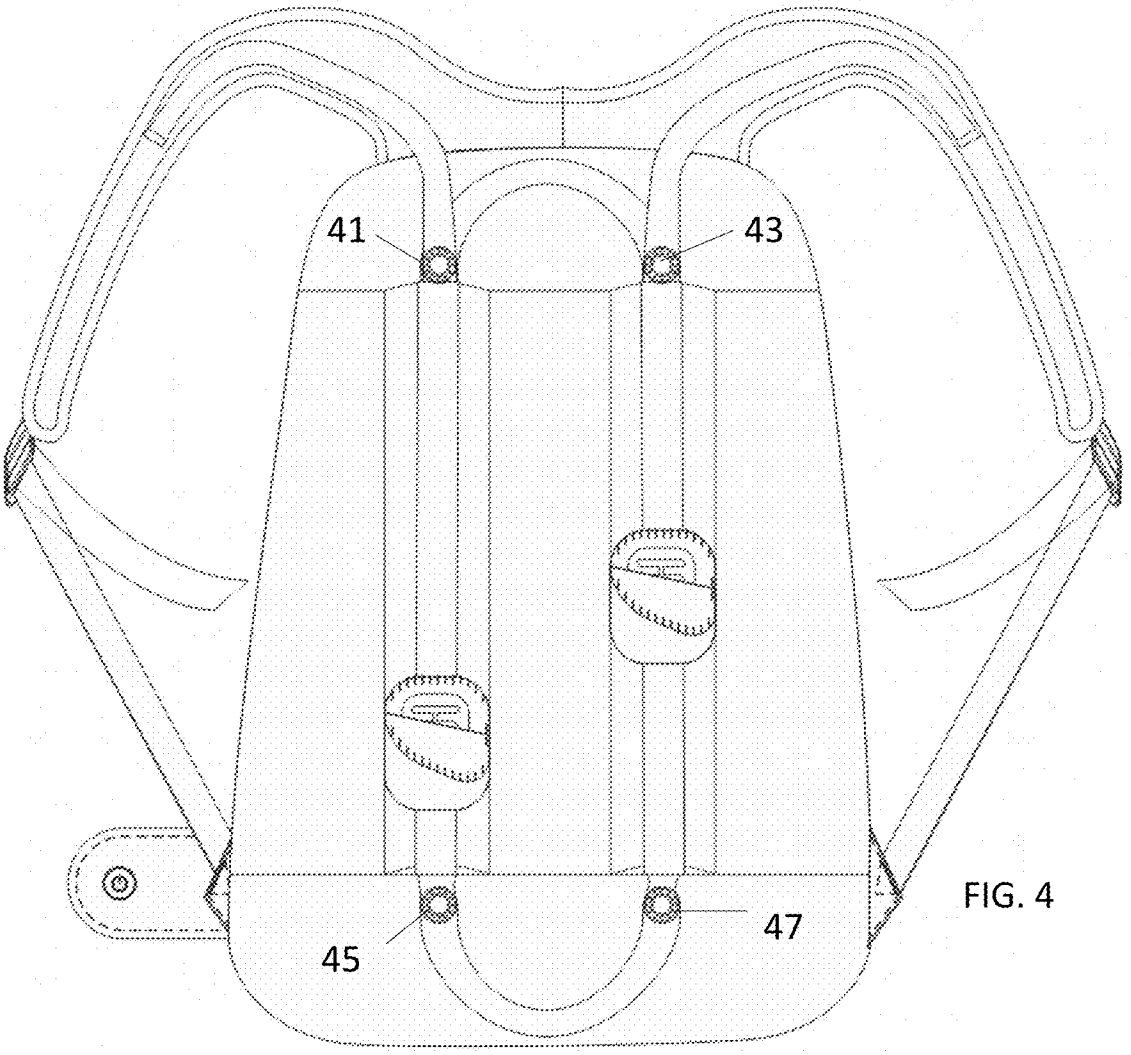
FIG. 4 depicts an adjustable massage apparatus with a roller according to the present invention.
Figure 11:
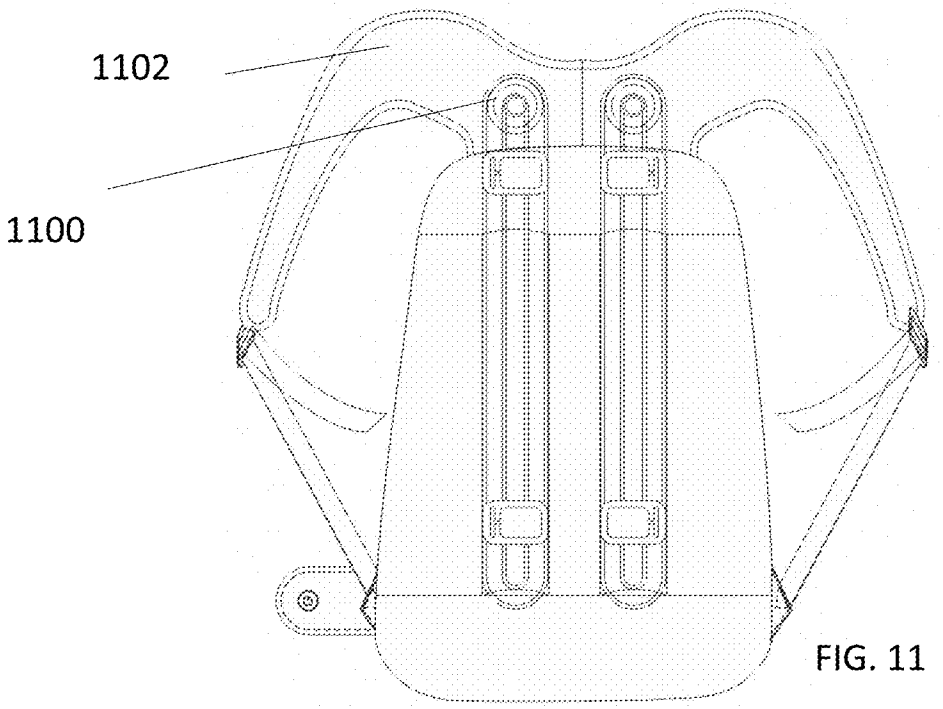
FIG. 11 depicts an adjustable massage apparatus with a roller system on the shoulder strap according to the present invention.
Figure 12:
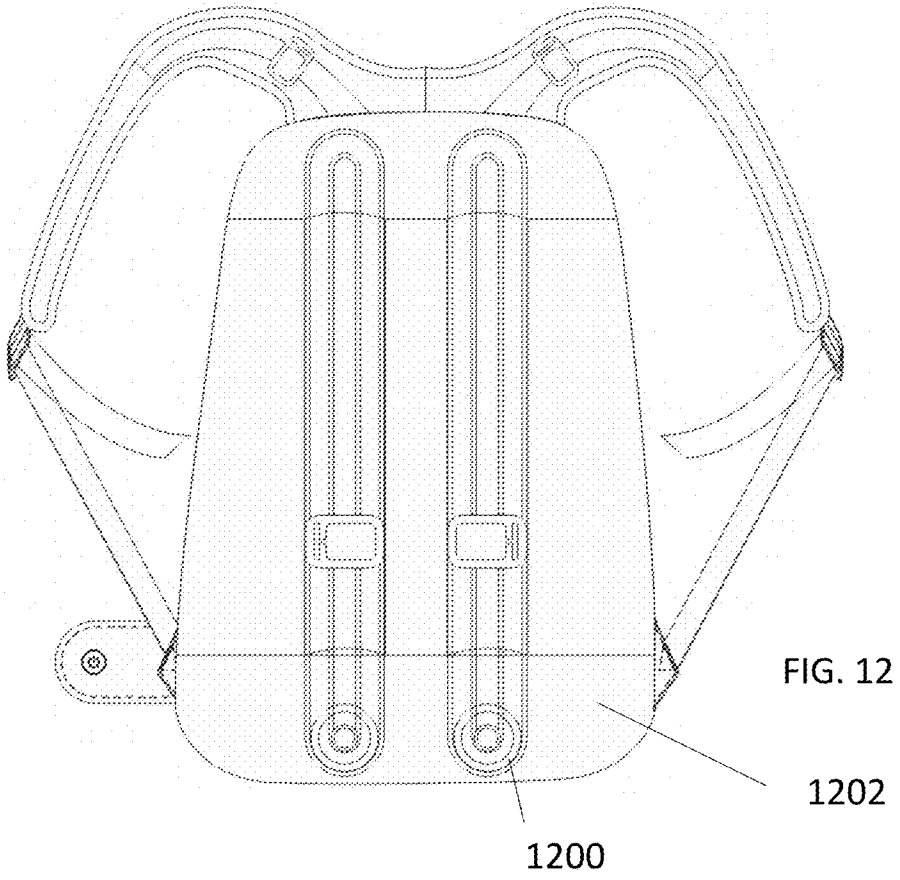
FIG. 12 depicts an adjustable massage apparatus with a roller system according to the present invention.
Figure 13:
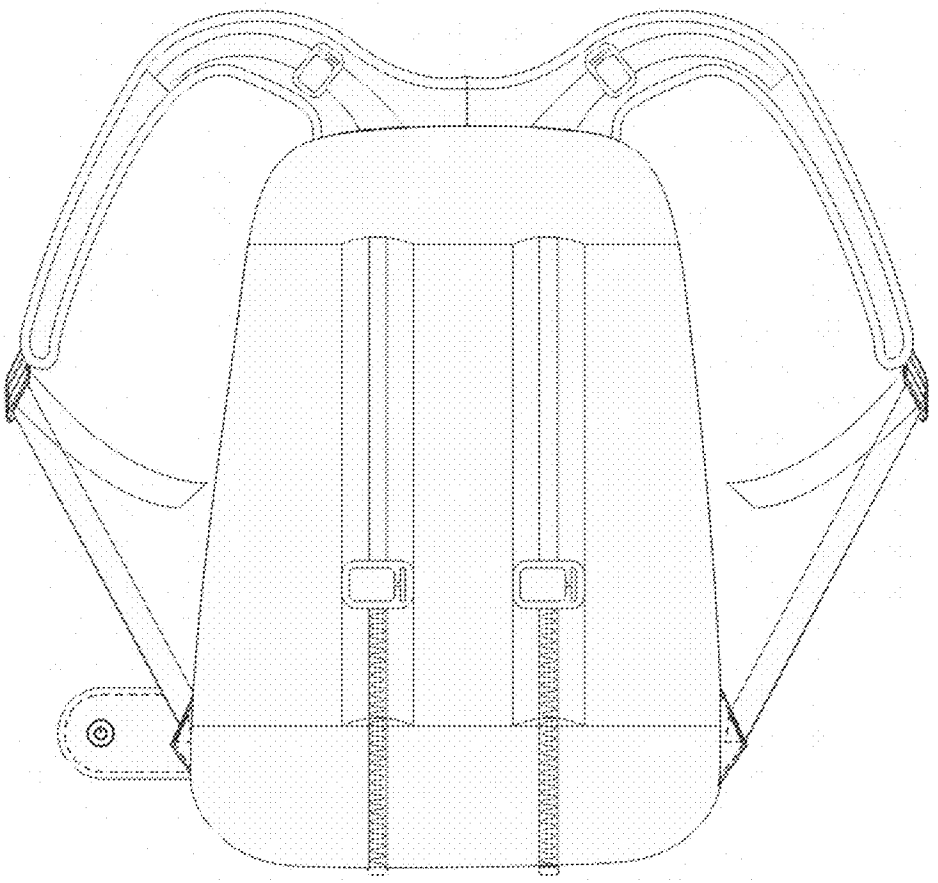
FIG. 13 depicts an adjustable massage apparatus according to the present invention.
Figure 14:
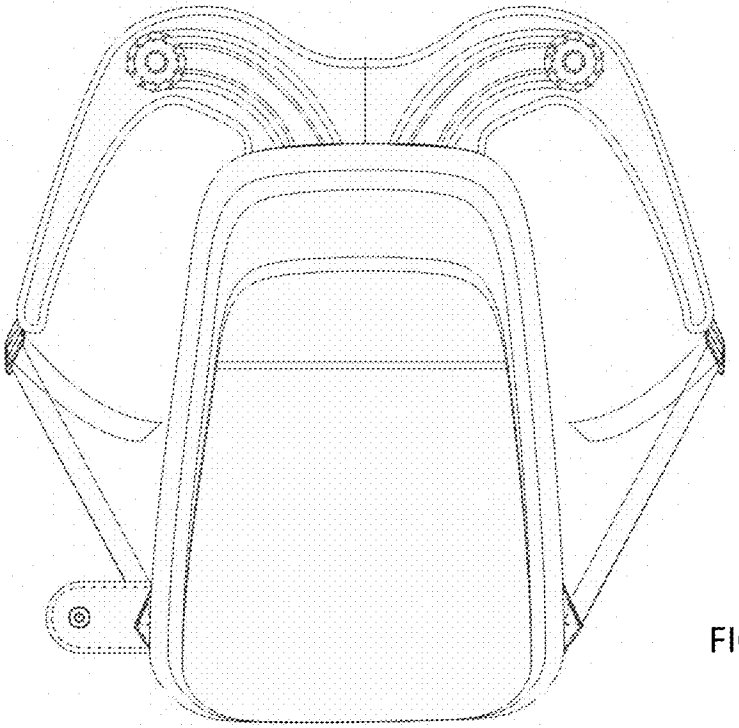
FIG. 14 depicts an adjustable massage apparatus with a roller system according to the present invention.
Figure 15:
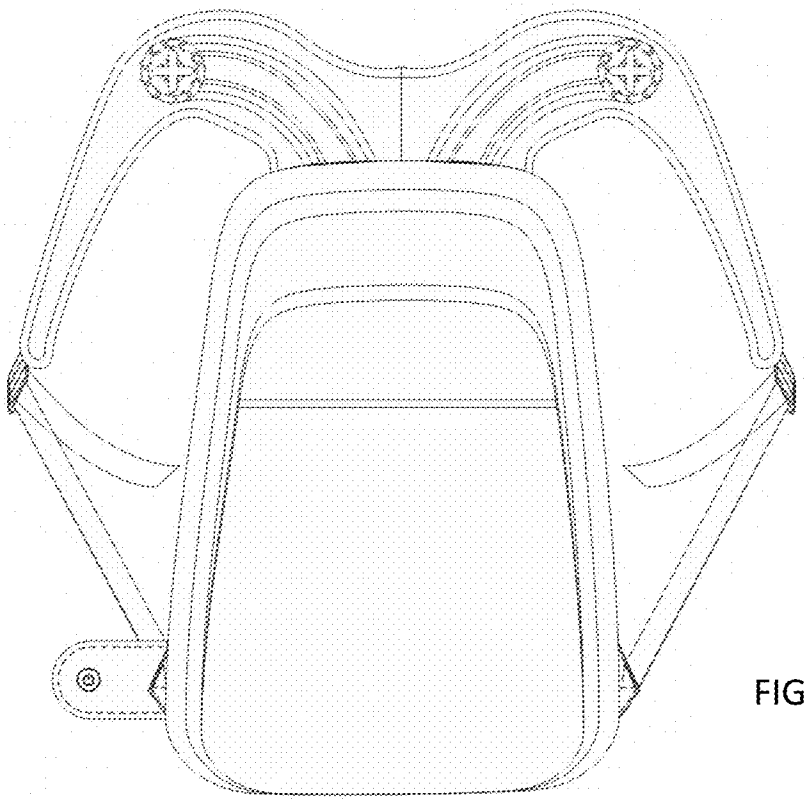
FIG. 15 depicts an adjustable massage apparatus with a roller system according to the present invention.
Figure 16:
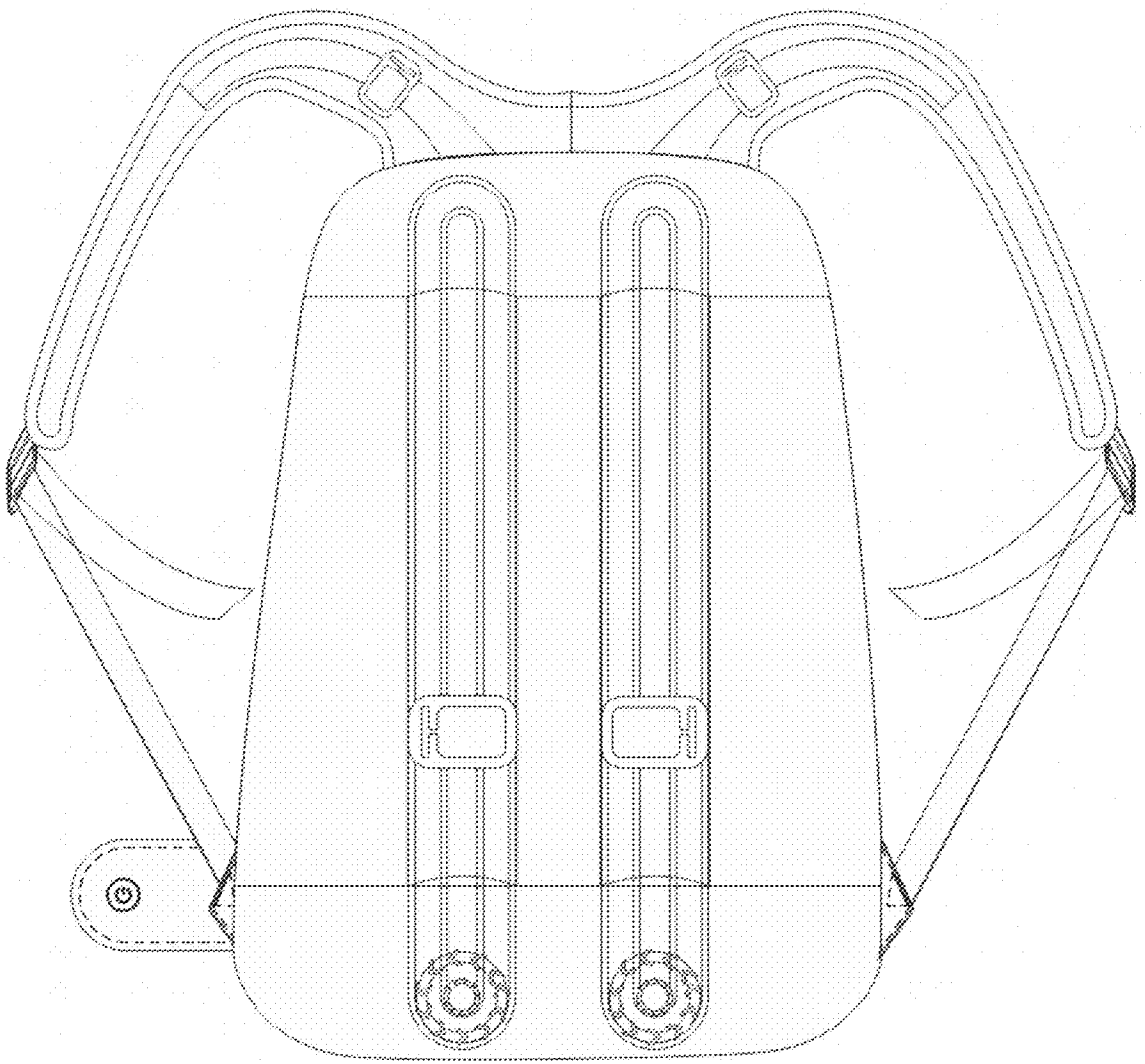
FIG. 16 depicts an adjustable massage apparatus with a roller system according to the present invention.
Figure 17:
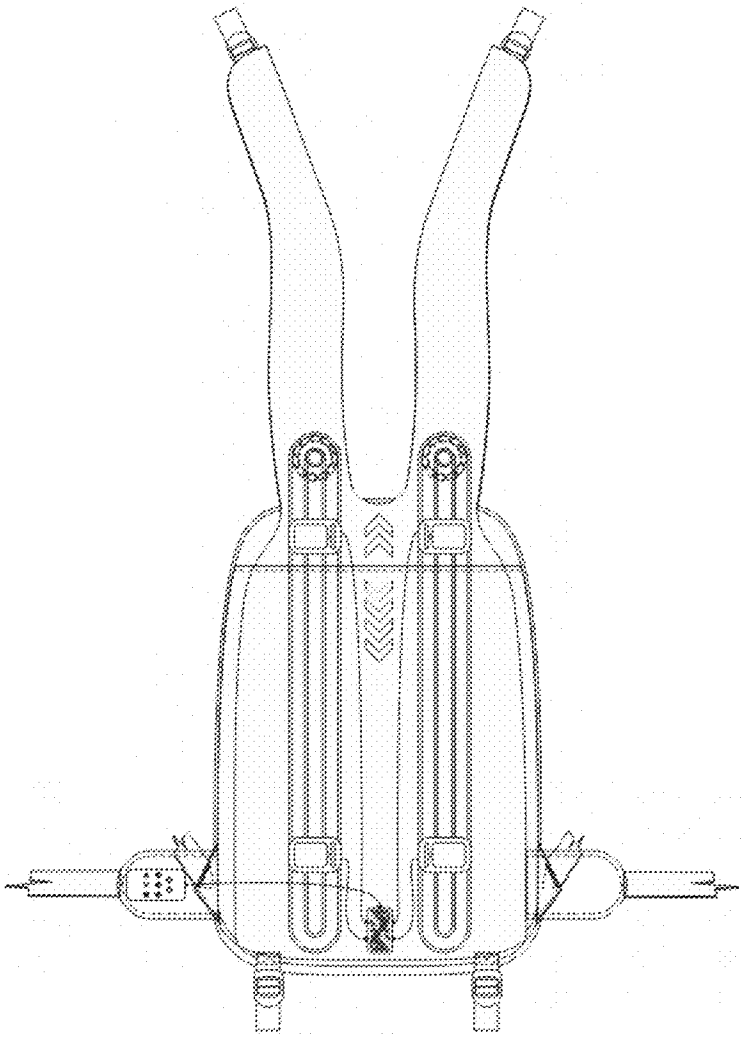
FIG. 17 depicts an adjustable massage apparatus with a roller system according to the present invention.
Figure 20:
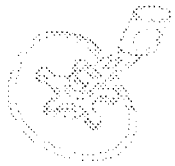
FIG. 20 depicts a roller according to the present invention.
Figure 19:
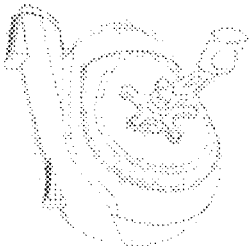
FIG. 19 depicts a roller according to the present invention.
Figure 18:
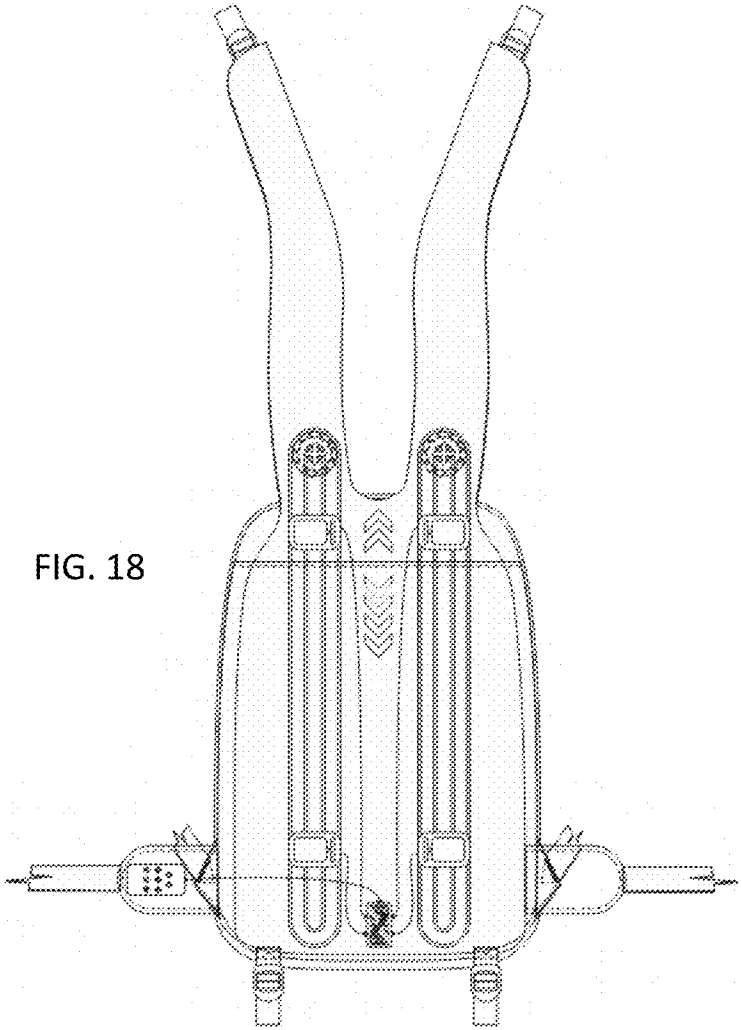
FIG. 18 depicts an adjustable massage apparatus with a roller system according to the present invention.

As depicted in FIG. 3, each of the massage heads (34, 36) may be fixed on a band having a first end (38) and a second end (40), the first end of band is assembled on one shoulder strap (42) to pull the massage head moving up, the second end (40) of the band is assembled on the other shoulder strap (44) to pull the massage head moving downward. The band may be further assembled with at least one roller (46) and the band runs along the roller system. FIG. 4 depicts another example of a roller system with rollers (41, 43, 45 and 47) along the band. As depicted in FIG. 11, there may also be a second roller (1100) on a shoulder strap (e.g. 1102). As depicted in FIG. 12, there may be a third roller (1200) on a waist patch (1202). FIGS. 19 and 20 depict two examples of roller systems.

Figure 6:
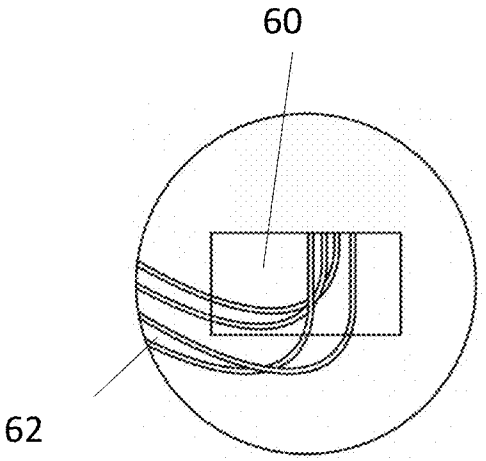
FIG. 6 depicts an opening in a tunnel for the cable to exit according to the present invention.

As depicted in FIG. 6, there may be an opening (60) in the tunnel for the massager cable (62). The massager cable (62) may be at least 5 mm longer than half of a length of the tunnel. The opening in the tunnel provides an exit for the massager cable, the cable leaving outside of the opening being at least 5 mm longer length than the half length of the tunnel, which will make the cable bearing no pulling stress, and not too long to wind with the band.

Figure 22:
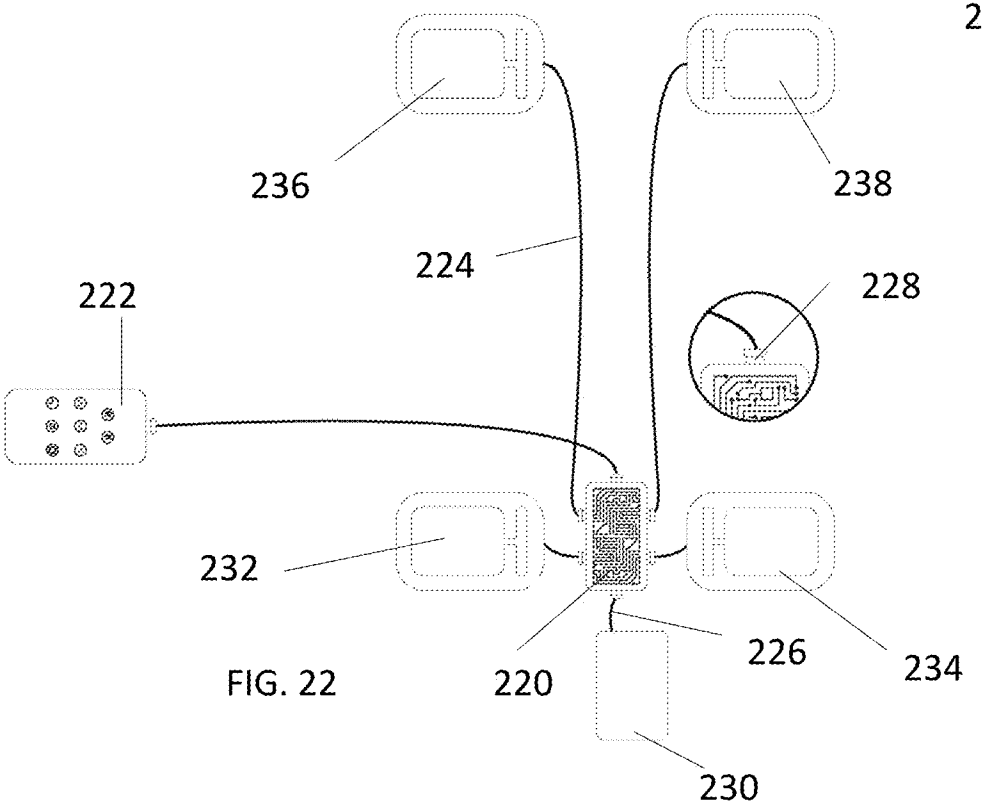
FIG. 22 depicts a wired solid function control board according to the present invention.
Figure 26:
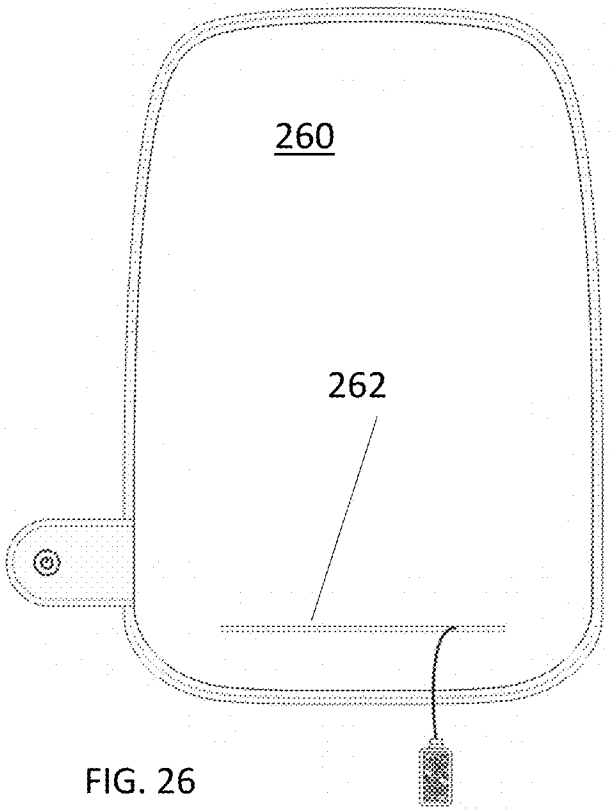
FIG. 26 depicts an opening according to the present invention.
Figure 25:
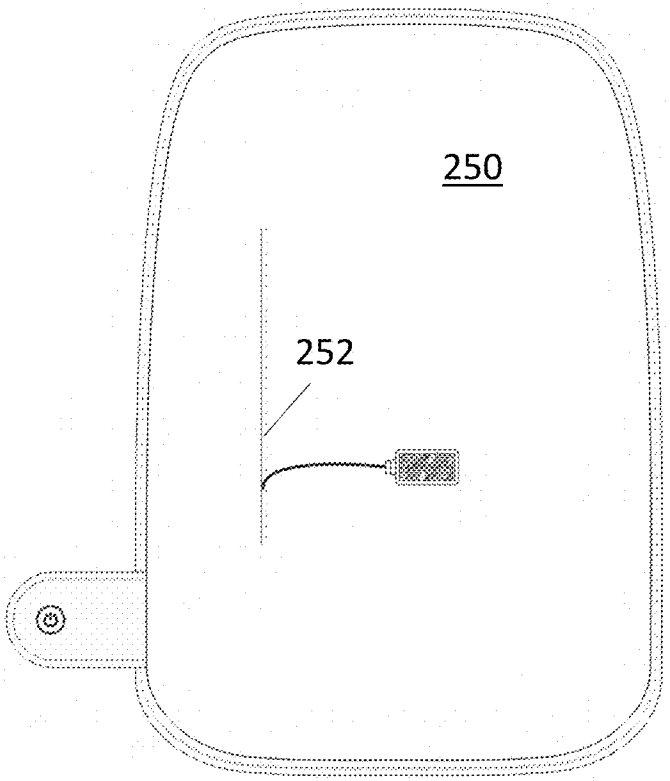
FIG. 25 depicts an opening according to the present invention.
Figure 29:
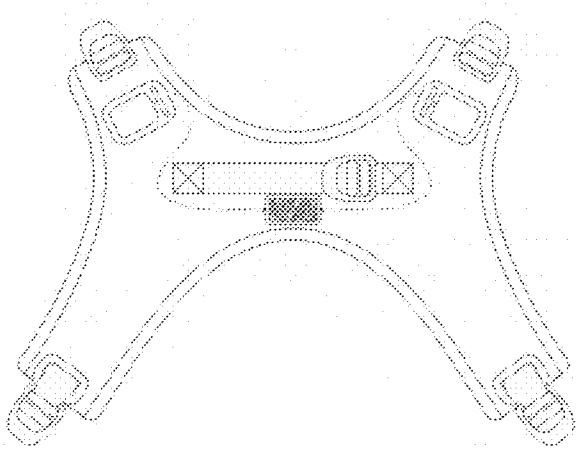
FIG. 29 depicts an embodiment attached to a back portion according to the present invention.
Figure 28:
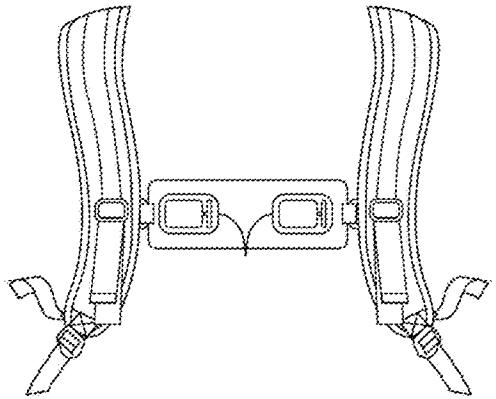
FIG. 28 depicts an embodiment attached to the shoulder straps according to the present invention.
Figure 27:
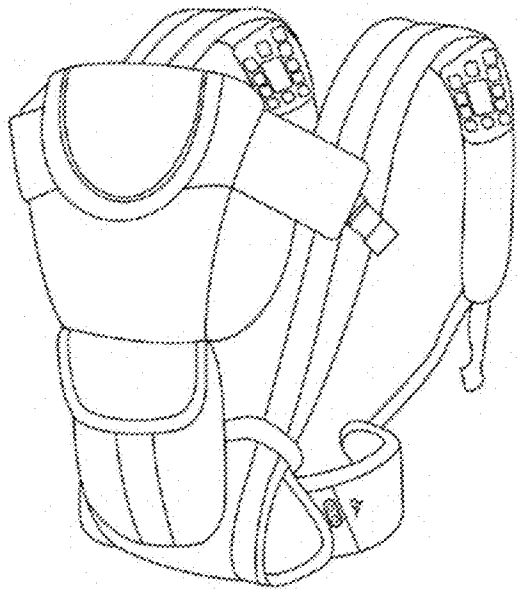
FIG. 27 depicts an embodiment as a baby carrier according to the present invention.

As depicted in FIG. 22, there may be a control circuit (220) in an interlining of the body and a function control board (222) for controlling the massage apparatus. The massage apparatus may have at least two massager cables (224 and 226), wherein each of the massager cables has at least one fast connector (228) on at least one of the massager cables connecting the massage head and the control circuit (220), the massage head (232, 234, 236 and 238) and the battery (230), the control circuit (220) and the battery (230) and the control circuit (220) and function control board (222). As depicted in FIGS. 25 and 26, the body (250, 260) may have an opening (252, 262) for replacing the control circuit. The function control board (222) can be a wired solid board (231) or a wireless connection controller (241). There may be a pocket on a portion of the body for storing a battery.

Figure 2:
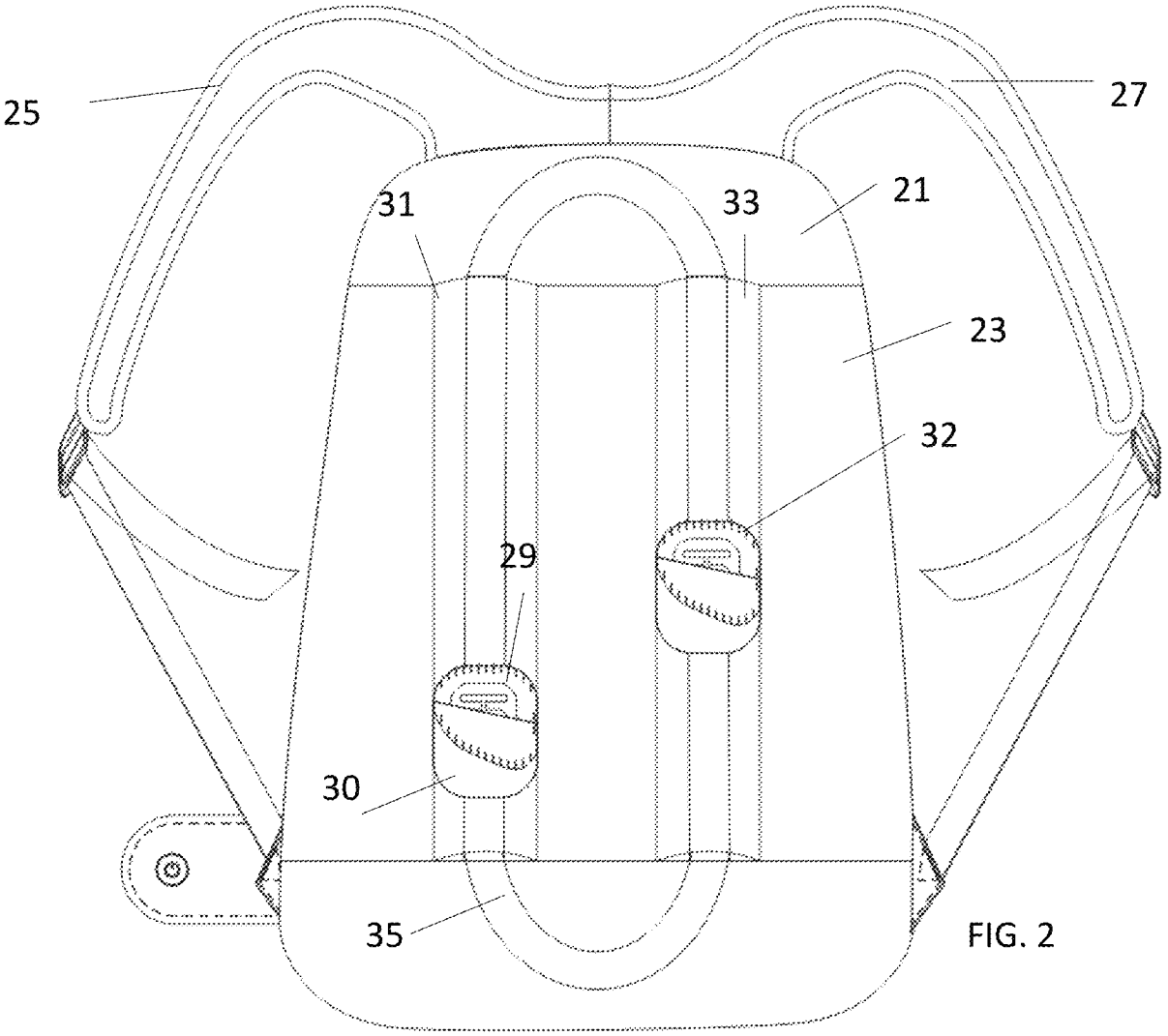
FIG. 2 depicts an adjustable massage apparatus with a massage head cover according to the present invention.

As depicted in FIG. 2, there may be an adjustable massage apparatus, comprising: a body (21), a back panel (23), and at least two shoulder straps (25, 27), wherein the back panel has at least one massage apparatus, wherein the back panel has a substantially rigid material that is at least 1 mm thick, wherein the massager apparatus has at least two massage heads (29), wherein the massage heads have covers (30) and are fixed on a platform (32). The massage heads are assembled in a tunnel (31, 33), the massage heads adjustably move inside the tunnel, wherein the tunnel is substantially the same width as the massage head platform (FIG. 5 depicts the massage head being substantially the same width as the massage head platform). The tunnel may be made from materials selected from the group consisting of fabric, mesh, elastic, rubber and foam. The platform (32) with massage heads (29) may be attached to at least one band (35). The cover may be of a material selected from the group consisting of fabric, mesh, elastic, rubber, silicon and foam. The platform may have a stiff bottom material selected from the group consisting of plastic board, cardboard and metal board. The may be fixed on at least one band by a sliding buckle (50). The platform may be fixed on a band by an antifriction bearing (74, 76). The platform may be fixed on a band having a first end and a second end, wherein the first end of each band is assembled on at least one of the shoulder straps, and the second end of each band is on any one or two of a waist patch. The first end of the band may be assembled on one shoulder strap to pull the massage head up and the second end of the band is assembled on the other shoulder strap to pull the massage head moving downward. The band may be further assembled with at least one roller and the band running along the at least one roller. There may also be a second roller (e.g. 1100) on the shoulder strap. There may also be a third roller (e.g. 45, 47) on a waist patch.

There may be an opening (60) in the tunnel and a massager cable (62), wherein the massager cable is at least 5 mm longer than half of a length of the tunnel. The opening in the tunnel provides an exit for the massager cable, the cable leaving outside of the opening being at least 5 mm longer length than the half length of the tunnel, which will make the cable bearing no pulling stress, and not too long to winding with webbing.

There may be a control circuit in an interlining of the body and a function control board for controlling the massage apparatus. The massage apparatus may have at least two cables, wherein each of the cables has at least one fast connector on at least one of the cables connecting the massage head and the control circuit, the massage head and the battery, the control circuit and the battery and the control circuit and function control board. The body may have an opening for replacing the control circuit. The function control board can be a wired solid board, or a wireless connection controller. There may be a pocket on a portion of the body storing a battery.

As will be recognized by those skilled in the art, the innovative concepts described in the present application can be modified and varied over a wide range of applications. Accordingly, the scope of patented subject matter should not be limited to any of the specific exemplary teachings discussed above, but is instead defined by the following claims.

I claim:

1. An adjustable massage apparatus, comprising:

a body, a back panel with at least one massage apparatus and at least two shoulder straps, wherein the back panel has a substantially rigid material that is at least 1 mm thick, wherein the massager apparatus has at least two massage heads, wherein each of the massage heads are retained on the back panel inside at least one tunnel, wherein each of the massage heads are fixed on a band to provide the massage head on the band and moving in the tunnel, and wherein the tunnel is substantially the same width as each of the massage heads.

2. An adjustable massage apparatus as in claim 1, wherein the tunnel is made from a material selected from the group consisting of fabric, mesh, elastic, rubber and foam.

3. An adjustable massage apparatus as in claim 1, wherein the massage head is held by a cover before being attached to the band.

4. An adjustable massage apparatus as in claim 3, wherein the cover is a material selected from the group consisting of fabric, mesh, elastic, rubber, silicon and foam.

5. An adjustable massage apparatus as in claim 3, wherein the cover is further equipped with a stiff bottom material selected from the group consisting of plastic board, cardboard and metalboard.

6. An adjustable massage apparatus as in claim 1, wherein the massage heads are fixed on at least one by a sliding buckle.

7. An adjustable massage apparatus as in claim 1, wherein the massage heads are fixed on a band by an antifriction bearing.

8. An adjustable massage apparatus as in claim 1, wherein each massage head is fixed on a band having a first end and a second end, the first end of each band is assembled on either one or two of the shoulder straps, and the second end of each band is assembled on either one or two of a waist patch.

9. An adjustable massage apparatus as in claim 1, wherein each of the massage heads is fixed on a band having a first end and a second end, the first end of band is assembled on one shoulder strap to pull the massage head moving up, the second end of the band is assembled on the other shoulder strap to pull the massage head moving downward.

10. An adjustable massage apparatus as in claim 1, wherein the band is further assembled with at least one roller, and the band runs along the roller system.

11. An adjustable massage apparatus as in claim 1, further comprising a second roller on shoulder strap.

12. An adjustable massage apparatus as in claim 1, further comprising a third roller on a waist patch.

13. An adjustable massage apparatus as in claim 1, further comprising an opening in the tunnel and a massager cable, wherein the massager cable is at least 5 mm longer than half of a length of the tunnel.

14. An adjustable massage apparatus as in claim 1, further comprising a control circuit in an interlining of the body and a function control board for controlling the massage apparatus.

15. An adjustable massage apparatus as in claim 14, wherein the function control board can be a wired solid board, or a wireless connection controller.

16. An adjustable massage apparatus as in claim 1, wherein the massage apparatus has at least two massager cables, wherein each of the massager cables has at least one fast connector on at least one of the massager cables connecting the massage head and the control circuit, the massage head and the battery, the control circuit and the battery and the control circuit and function control board.

17. An adjustable massage apparatus as in claim 1, wherein the body further comprise an opening for replacing the control circuit.

18. An adjustable massage apparatus as in claim 1, further comprising a pocket on a portion of the body for storing a battery.

19. An adjustable massage apparatus, comprising:

a body, a back panel, and at least two shoulder straps, wherein the back panel has at least one massage apparatus, wherein the back panel has a substantially rigid material that is at least 1 mm thick, wherein the massager apparatus has at least two massage heads, wherein the massage heads have covers and are fixed on a platform, wherein the massage heads are assembled in a tunnel, the massage heads adjustably move inside the tunnel, wherein the tunnel is substantially the same width as the massage head platform.

20. An adjustable massage apparatus as in claim 19, wherein the tunnel is made from materials selected from the group consisting of fabric, mesh, elastic, rubber and foam.

21. An adjustable massage apparatus as in claim 19, wherein the cover is of a material selected from the group consisting of fabric, mesh, elastic, rubber, silicon and foam.

22. An adjustable massage apparatus as in claim 19, further comprising an opening in the tunnel and a massager cable, wherein the massager cable is at least 5 mm longer than half of a length of the tunnel.

23. An adjustable massage apparatus as in claim 19, further comprising a control circuit in an interlining of the body and a function control board for controlling the massage apparatus.

24. An adjustable massage apparatus as in claim 23, wherein the function control board can be a wired solid board, or a wireless connection controller.

25. An adjustable massage apparatus as in claim 19, wherein the massage apparatus has at least two cables, wherein each of the cables has at least one fast connector on at least one of the cables connecting the massage head and the control circuit, the massage head and the battery, the control circuit and the battery and the control circuit and function control board.

26. An adjustable massage apparatus as in claim 19, wherein the body has an opening for replacing the control circuit.

27. An adjustable massage apparatus as in claim 19, further comprising a pocket on a portion of the body storing a battery.

28. An adjustable massage apparatus, comprising:

a body, a back panel, and at least two shoulder straps, wherein the back panel has at least one massage apparatus, wherein the back panel has a substantially rigid material that is at least 1 mm thick, wherein the massager apparatus has at least two massage heads, wherein the massage heads have covers and are fixed on a platform, wherein the platform with massage heads is attached to at least one band.

29. An adjustable massage apparatus, comprising:

a body, a back panel, and at least two shoulder straps, and at least one massage apparatus, wherein the back panel has a substantially rigid material that is at least 1 mm thick, wherein the massager apparatus has at least two massage heads, wherein the massage heads have covers and are fixed on a platform, wherein the platform has a stiff bottom material selected from the group consisting of plastic board, cardboard and metal board.

30. An adjustable massage apparatus, comprising:

a body, a back panel, and at least two shoulder straps, and least one massage apparatus, wherein the back panel has a substantially rigid material that is at least 1 mm thick, wherein the massager apparatus has at least two massage heads, wherein the massage heads have covers and are fixed on a platform, wherein the platform is fixed on at least one band.

31. An adjustable massage apparatus as in claim 30, wherein the platform is fixed on a band by an antifriction bearing or a sliding buckle.

32. An adjustable massage apparatus as in claim 30, wherein the band has a first end and a second end, wherein the first end of each band is assembled on at least one of the shoulder straps, and the second end of each band is on any one or two of a waist patch.

33. An adjustable massage apparatus as in claim 32, wherein the first end of the band is assembled on one shoulder strap to pull the massage head up and the second end of the band is assembled on the other shoulder strap to pull the massage head moving downward.

34. An adjustable massage apparatus as in claim 32, wherein the band is further assembled with at least one roller and the band is running along the at least one roller.

35. An adjustable massage apparatus as in claim 34, further comprising a second roller on the shoulder strap.

36. An adjustable massage apparatus as in claim 35, further comprising a third roller on a waist patch.

* * * * *